United States Patent [19]

Ivie et al.

[11] Patent Number: 5,029,656

[45] Date of Patent: Jul. 9, 1991

[54] NOZZLE MEANS FOR ROTARY DRILL BITS

[75] Inventors: Craig R. Ivie; David E. Pearce, both of Houston, Tex.

[73] Assignee: Camco International Inc.

[21] Appl. No.: 502,046

[22] Filed: Mar. 30, 1990

Related U.S. Application Data

[63] Continuation-in-part of Ser. No. 381,040, Jul. 17, 1989, Pat. No. 4,989,680.

[51] Int. Cl.[5] ..... 175 340; 175 339; 175 424

[52] U.S. Cl. ..... 175/340; 175/424; E21B/10/18

[58] Field of Search ..... 175/340, 339, 424

[56] References Cited

U.S. PATENT DOCUMENTS

| | | | |
|---|---|---|---|
| 1,143,274 | 6/1915 | Hughes | 175/339 X |
| 2,108,955 | 2/1938 | Zublin | 175/340 |
| 2,873,092 | 2/1959 | Dwyer | 175/340 X |
| 2,885,186 | 5/1959 | Hasmmer | 175/340 |
| 3,137,354 | 6/1964 | Crawford et al. | 175/340 |
| 3,144,087 | 8/1964 | Williams Jr. | 175/339 |
| 3,618,682 | 11/1971 | Bennett | 175/65 |
| 4,222,447 | 9/1980 | Cholet | 175/340 |
| 4,351,402 | 9/1982 | Gonzalez | 175/340 |
| 4,619,335 | 10/1986 | McCullough | 175/340 X |
| 4,657,093 | 4/1987 | Schumacher | 175/353 |
| 4,673,045 | 6/1987 | McCullough | 175/339 |
| 4,741,406 | 5/1988 | Deane et al. | 175/340 |
| 4,848,476 | 7/1989 | Deane et al. | 175/340 |

FOREIGN PATENT DOCUMENTS

| | | | |
|---|---|---|---|
| 36772 | 9/1981 | European Pat. Off. | 175/340 |
| 258972 | 4/1970 | U.S.S.R. | 175/339 |
| 344099 | 8/1972 | U.S.S.R. | 175/339 |

*Primary Examiner*—Hoang C. Dang

*Attorney, Agent, or Firm*—Dodge, Bush, Moseley & Riddle

[57] ABSTRACT

A rotary drill bit (10) has fluid discharge nozzles (36A, 36B, 36C) positioned between adjacent pairs of roller cutters (20A, 20B, 20C). A fluid discharge nozzle (36A) provides a stream of drilling fluid (44) toward an adjacent roller cutter (20A) inclined radially outwardly toward the side wall (34) of the bore hole (30) and slanted toward the roller cutter (20A) for first striking the side wall (34), and then sweeping inwardly across the bore hole bottom (32) in a flat high velocity stream tangential to bit rotation and beneath the cutting elements (26) during cutting engagement of the gage row (28D) with the formation.

10 Claims, 4 Drawing Sheets

NOZZLE MEANS FOR ROTARY DRILL BITS

CROSS REFERENCE TO RELATED APPLICATION

This application is a continuation-in-part of pending application Ser. No. 381,040 filed July 17, 1989, now U.S. Pat. No. 4,989,680.

BACKGROUND OF THE INVENTION

This invention relates to improved nozzle means for rotary drill bits, and more particularly to improved nozzle means for directing drilling fluid first against the side wall of the formation being cut and then underneath the roller cutters of drill bits.

Heretofore, such as shown in U.S. Pat. No. 4,741,406, various types of discharge nozzles for discharging drilling fluid against roller cutters of a rotary drill bit have been utilized. Some of the prior nozzles have been positioned to discharge drilling fluid in a direction toward the surface or side of the roller cutters and some of the nozzles have been positioned and constructed to discharge drilling fluid in a direction against the side wall of the bore hole. However, the arrangement of such discharge nozzles heretofore has not provided an optimum use of hydraulic cleaning action for the efficient cleaning of the hole bottom including the corner of the hole, while adequately cleaning the cutting elements.

The most important area of the hole to adequately clean is the corner of the hole at the juncture of the side wall with the bottom where cuttings are most likely to pack particularly in so called sticky formations. Also the corner is stronger than the flat hole bottom and is more difficult to drill. It is also important to effectively clean the rest of the hole bottom. To most effectively clean the formation it is important to achieve a high tangential velocity sweeping across the surface of the formation, both at the corner of the hole and the bottom of the hole. Also in sticky formations the cutting elements need to be cleaned to more efficiently penetrate the formation. It has been found that it is most desirable to clean the formation and the cutting elements during engagement and just prior to engagement with formation.

Prior art drill bits have not effectively cleaned the corner of the hole and then effectively cleaned the hole bottom because they lack a high velocity flat stream sweeping across the corner of the hole and the hole bottom in a direction tangential to the hole bottom beneath the cutting elements of an adjacent roller cutter.

SUMMARY OF THE INVENTION

The present invention is directed to a rotary drill bit having a plurality of roller cutters with a plurality of concentric rows of cutting elements on each cutter, and nozzle means positioned on the drill bit to direct a high velocity liquid stream in a manner to provide an improved cleaning action particularly for the corner of the hole and the bottom of the hole. It is noted that dead spots for the drilling fluid along the bottom surface of the bore hole normally occur beneath the roller cutters and particularly at bottom areas where the cutting elements engage the bottom surface.

The present invention is particularly directed toward providing high velocity high volume drilling fluid across the bore hole bottom in a tangential direction beneath the cutting elements of the roller cutters during cutting engagement of the cutting elements with the bore hole bottom while also effectively cleaning the corner of the bore hole. This is accomplished by the high velocity stream first striking the side wall above the lowermost cutting elements in the gage row of an adjacent roller cutter and then sweeping across the hole corner and hole bottom and beneath the cutting elements of the adjacent roller cutter in a relatively flat high velocity tangential stream during cutting engagement of the cutting elements with the hole corner and hole bottom. As a result, an improved rate of penetration is obtained, particularly in so called "sticky" formations.

It is noted that the gage row of each roller cutter is the row that most affects the rate of penetration of the rotary drill bit. The gage row normally has more cutting elements therein than the remaining rows. Also, the formation is stronger at the annular corner of the bore hole formed at the juncture of the horizontal bottom surface and the vertically extending cylindrical side surface of the bore hole formation. Thus, the gage row of cutting elements is the critical row in determining the rate of penetration.

Additionally, in a rotary drill bit having three roller cutters, a so-called "interlocking" row of cutting elements is provided immediately adjacent the gage row on at least one of the three roller cutters. The interlocking row includes cutting elements which are staggered and fit between the cutting elements of the gage row in radially offset relation. The interlocking row of cutting elements along with the gage row are thus provided for cutting the formation at its strongest area. It is desirable that maximum cleaning action by the pressurized drilling fluid be provided particularly for the cutting elements in such gage and interlocking rows, immediately prior to and during engagement of such cutting elements with the formation.

Application Ser. No. 381,040, now U.S. Pat. No. 4,989,680, relates to a roller cutter drill bit in which a high velocity stream of drilling fluid is directed against the cutting elements in the gage row to provide an increased hydraulic action first against the cutting elements in the gage row and then sequentially against the bore hole bottom generally adjacent the corner of the bore hole.

The present invention likewise is directed to an improved hydraulic action for the cutting elements in the gage row. However, the drilling fluid is discharged in a direction toward an adjacent roller cutter with the center of the volume of drilling fluid first striking the side wall of the bore hole above the lowermost cutting elements of the gage row, and then turning at the hole corner to sweep inwardly underneath the cutting elements during cutting engagement of the cutting elements with the formation. The stream of drilling fluid is angled against the side wall and adjacent roller cutter in such a manner that the velocity of the drilling fluid sweeping under the cutting elements is not substantially reduced after striking the side wall of the bore hole so that adequate velocity is retained for sweeping under the roller cutter in a tangential direction across the corner and bottom surfaces of the hole away from the side wall. The high velocity stream after striking the side wall sweeps in a thin high volume stream beneath the cutter across the bottom hole surface to scour and clean the corner and bottom surfaces during engagement of the cutting elements. In order that the velocity not be substantially reduced after striking the side wall, it has been found that the stream of drilling fluid (i.e. the center of the volume of discharged drilling fluid) be inclined radially outward at an angle preferably of around fifteen degrees with respect to the rotational axis of the drill bit. An angle of at least around five degrees and not greater than around thirty five degrees would function satisfactorily under various operating conditions.

In addition, the stream of drilling fluid is slanted or skewed toward an adjacent roller cutter at a sufficient angle to provide a sweeping action from the side wall underneath the cutting elements of the associated cutter in a tangential flow path across the corner and bottom surfaces of the hole for the effective cleaning of the formation during engagement of the cutting elements. A slant angle toward the roller cutter of around twenty degrees has been found to be optimum for directing maximum fluid flow underneath the roller cutter and across the corner and hole bottom with minimal dispersal of the drilling fluid after striking of the side wall. A slant angle of at least around ten degrees and less than around thirty five degrees has resulted in improved penetration rates under various operating conditions.

The improved nozzle means includes a nozzle positioned on the drill bit between a pair of adjacent cutters at a sufficient height to discharge a high velocity stream of drilling fluid in a radially outward direction with respect to the rotational axis of the bit against the side wall of the bore hole with the center of the volume of discharged drilling fluid first striking the side wall of the bore hole above the lowermost cutting elements of the gage row of an adjacent cutter. The discharged drilling fluid stream is also slanted or skewed in a direction toward the adjacent cutter in order to obtain the desired high velocity tangential sweeping action of a generally flat stream beneath the cutting elements and across the corner and bottom surfaces during cutting engagement of the cutting elements with the formation. It is desirable that a high velocity high volume sweeping action occur across the corner and bottom surfaces underneath the leading side of the trailing adjacent cutter including the gage row of cutting elements after the stream of drilling fluid strikes the side wall of the bore hole with a minimum loss of velocity and minimum dispersal of the drilling fluid. By maintaining maximum velocity and minimum dispersal after striking the side wall, a strong flow of fluid is provided across the corner and hole bottom underneath the cutting elements with the drilling fluid engaging the cutting elements immediately before and during cutting engagement of the cutting elements with the formation.

It is an object of the present invention to provide a rotary drill bit in which a stream of drilling fluid is directed from a nozzle against an adjacent roller cutter for sweeping inwardly in a flattened tangential stream from a side wall of the bore hole across the hole corner and the hole bottom underneath the cutting elements of the cutter during engagement of the cutting elements with the formation.

It is a further object of the present invention to provide such a rotary drill bit in which the nozzle for discharging the high velocity stream of drilling fluid is at a sufficient height and angled relative to the adjacent roller cutter and side wall of the bore hole so that the high velocity stream of drilling fluid first contacts the side wall and then sweeps inwardly across the hole bottom underneath the cutting elements of the cutter with a minimal reduction in velocity and minimal dispersal of the stream after striking the side wall.

An additional object of the present invention is to provide a nozzle for the stream of drilling fluid positioned on the drill bit between a pair of roller cutters and directing the drilling fluid radially outward against the side wall of the bore hole and toward an adjacent roller cutter to strike the bore hole side at an angle less than thirty five degrees thereby to minimize the reduction in velocity of the drilling fluid after striking the side wall for subsequent inward sweeping around the gage corner and under the cutting elements of the cutter during engagement of the cutting elements with the hole bottom.

Other objects, features, and advantages of this invention will become more apparent after referring to the following specification and drawings.

DESCRIPTION OF THE INVENTION

Figure 1:
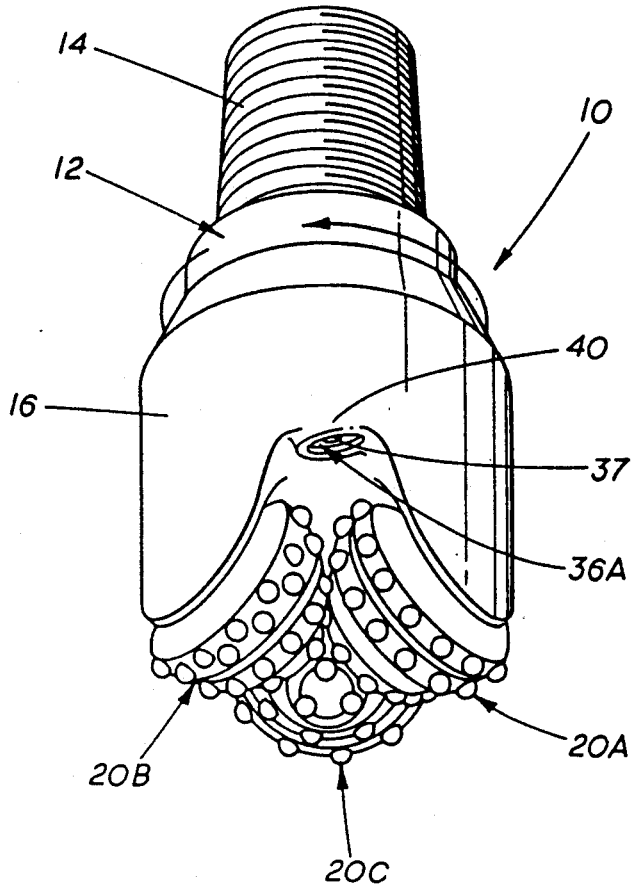
FIG. 1 is a perspective of the rotary drill bit of this invention including three cones or roller cutters of a generally conical shape thereon and discharge nozzles along the outer periphery of the bit body.
Figure 2:
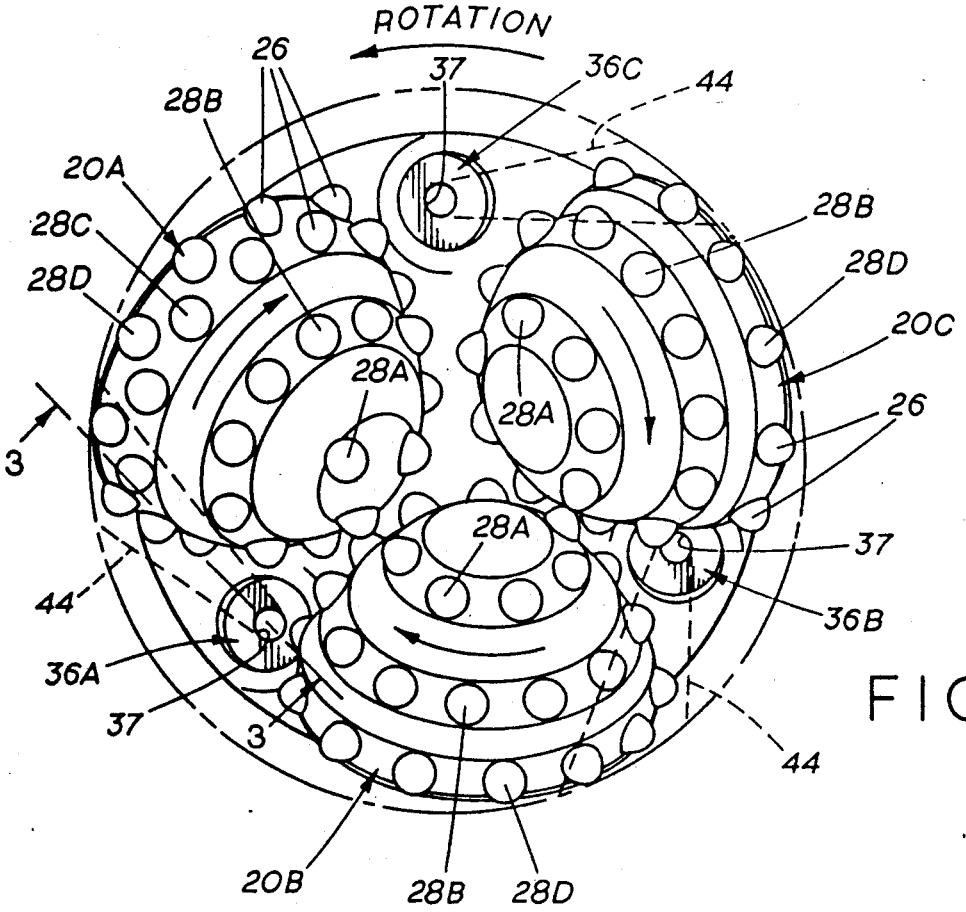
FIG. 2 is an axial plan view of the rotary drill bit of FIG. 1 showing the three roller cutters with annular rows of cutting elements thereon and a nozzle between each pair of adjacent roller cutters.

Referring now to the drawings for a better understanding of this invention, and more particularly to FIGS. 1–2, a rotary drill bit 10 is shown in FIG. 1 comprising a central main body or shank 12 with an upwardly extending threaded pin 14. Threaded pin 14 comprises a tapered pin connection adapted for threadedly engaging the female end of a drill string (not shown) which is connected to a source of drilling fluid at a surface location.

Figure 3:
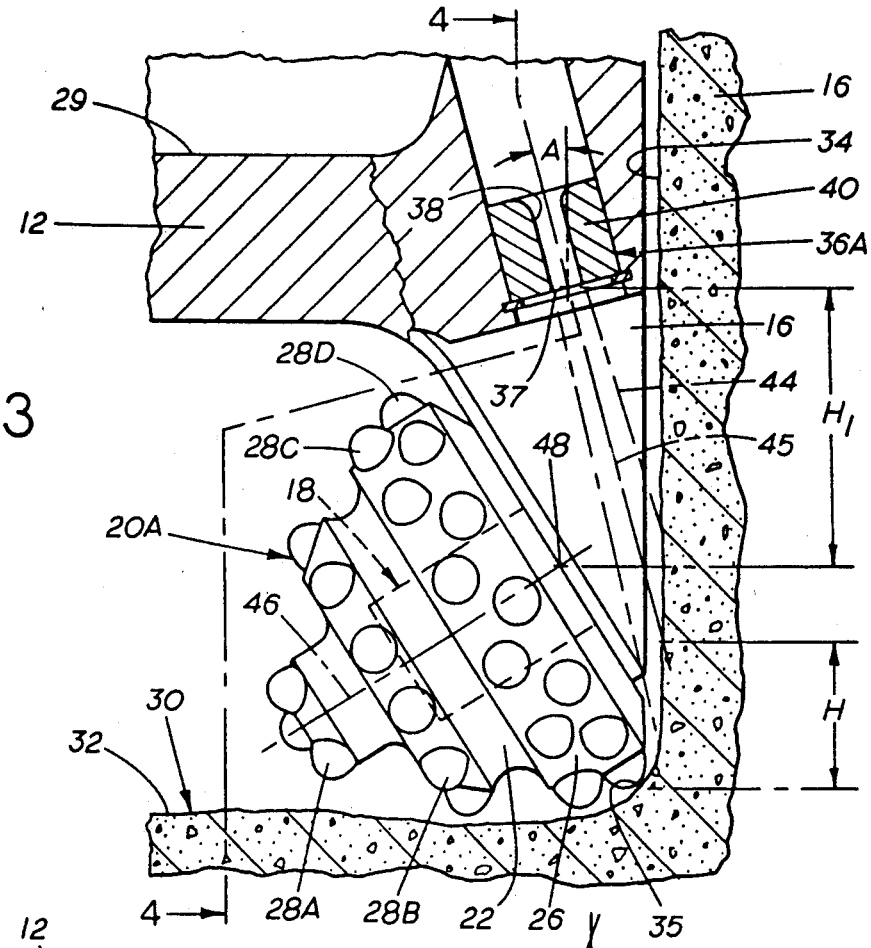
FIG. 3 is a generally schematic view of the stream of drilling fluid taken generally along line 3—3 of FIG. 2 and showing the drilling fluid directed radially outwardly against the side wall of the bore hole for cleaning the corner of the bore hole and for sweeping across the bottom surface under the cutting elements of an associated roller cutter.
Figure 4:
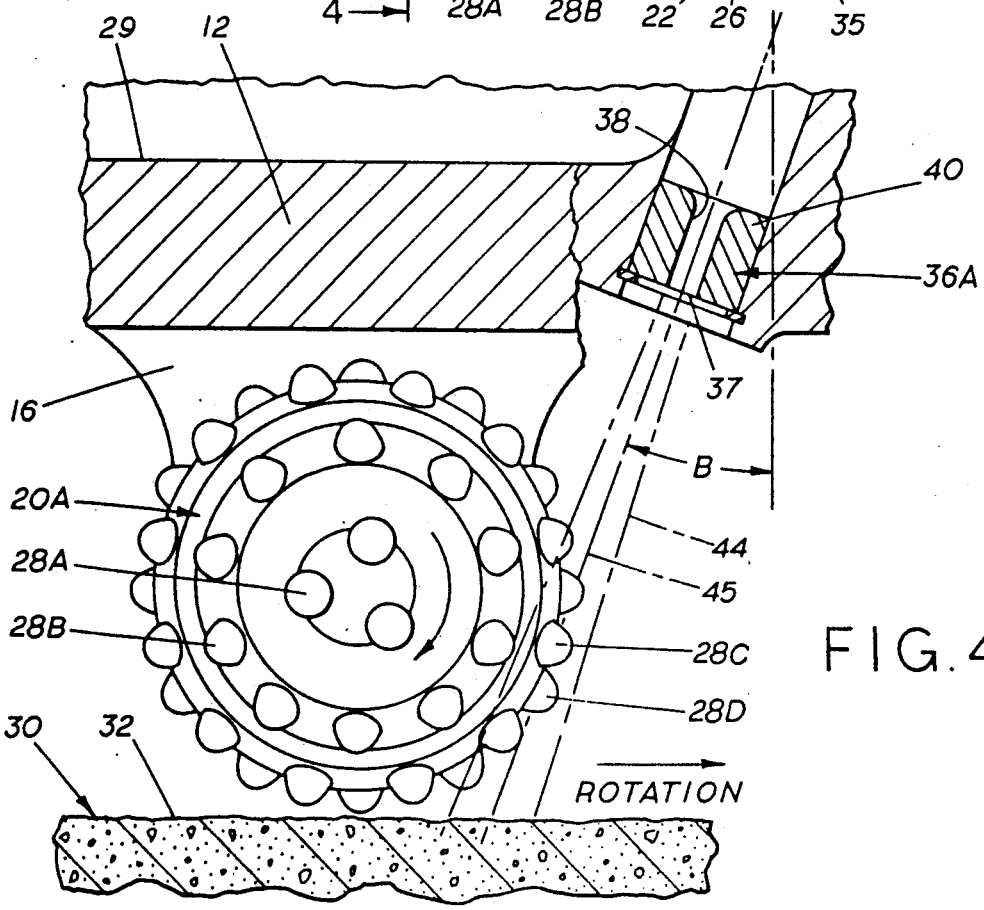
FIG. 4 is a generally schematic view taken generally along line 4—4 of FIG. 3 and showing the stream of drilling fluid slanted toward an adjacent roller cutter with a portion of the stream striking the cutting elements in the gage row immediately prior to engagement of the cutting elements with the formation for sweeping inwardly under the cutting elements across the hole bottom.

Main body or shank 12 is formed from three integral connected lugs defining three downwardly extending legs 16. Each leg 16 has an inwardly and downwardly extending, generally cylindrical bearing journal 18 at its lower end as shown in FIG. 3. Roller cutters 20A, 20B, and 20C are mounted on journals 18 for rotation and each roller cutter is formed of a generally conical shape. Each roller cutter 20A, 20B, and 20C comprises a generally conical body 22 having a recess therein receiving an associated bearing journal 18. A plurality of generally elongate cutting elements or inserts 26 have cylindrical bodies mounted in sockets within body 22 and outer trips extending from the outer ends of inserts 26. Cutting elements 26 may be made of a suitable powder metallurgy composite material having good abrasion and erosion resistant properties, such as sintered tungsten carbide in a suitable matrix. A hardness from about 85 Rockwell A to about 90 Rockwell A has been found to be satisfactory.

Cutting elements 26 are arranged on body 22 in concentric annular rows 28A, 28B, 28C, and 28D. Row 28D is the outermost row and comprises the gage row of cutting elements 26 that determines the final diameter or gage of the formation bore hole which is generally indicated at 30. Row 28C is adjacent to row 28D and comprises an interlocking row on cutter 20A. Cutting elements 26 on row 28C are staggered circumferentially with respect to cutting elements 26 on row 28D and a portion of cutting elements 26 on interlocking row 28C projects within the circular cutting path of row 28D. Thus, the cutting paths of the cutting elements 26 on rows 28C and 28D of roller cutter 20A overlap. It is noted that cutters 20B and 20C do not have interlocking rows as adjacent rows 28B are spaced substantially inward of row 28D and cutting elements 26 on row 28B do not project within the cutting path of row 28D for cutters 20B and 20C. In some instances, it may be desirable to provide two cutters or possibly all of the cutters with interlocking rows of cutting elements.

Bore hole 30 includes a horizontal bottom surface as portion 32 and an adjacent cylindrical side wall 34 extending vertically generally at right angles to horizontal bottom 32. The corner or juncture of horizontal bottom 32 and cylindrical side wall 34 is shown at 35. The cutting elements 26 on gage row 28D engage the formation in cutting relation generally at the corner or juncture 35 formed by the generally horizontal bottom 32 and the vertical side wall 34.

To provide high velocity drilling fluid for the improved cleaning action, particularly for the gage row 28D and adjacent interlocking row 28C of cutting elements 26, a directed nozzle fluid system is provided. The fluid system includes a plurality of nozzles indicated at 36A, 36B, and 36C with a nozzle positioned on bit body 12 between each pair of adjacent roller cutters at a radial location closer to the bore hole side wall 34 than to the axis of rotation of the bit as shown particularly in FIGS. 2 and 5. Each nozzle 36 has a drilling fluid passage 38 thereto from the drill string which provides high velocity drilling fluid for discharge from port 37.

For the purposes of illustrating the positioning and angling of the nozzles and associated orifices for obtaining the desired angling of the discharged streams of drilling fluid, reference is made particularly to FIGS. 3–6 in which nozzle 36A and roller cutter 20A are illustrated. It is to be understood that nozzles 36B and 36C function in a similar manner for respective roller cutters 20B and 20C.

Nozzle 36A has a nozzle body 40 defining a discharge orifice or port 37 for directing a fluid stream therefrom as shown at 44. Fluid stream 44 is shown of a symmetrical cross section and having a fan angle of around five to twenty degrees for example about the entire circumference of the stream with the centerline of the volume of discharged fluid shown at 45. Other fan angles or nonsymmetrical cross sections for fluid stream 44 may be provided, if desired. The rotational axis of cutter 20A is shown at 46 in FIG. 3 and axis 46 intersects leg 16 at point 48. While shown in FIG. 3 above the uppermost surface of cutter 20, nozzle 36A preferably is positioned with discharge orifice or port 37 at a height below the uppermost surface of roller cutter 20 and at least at a height above the intersection point 48 of the rotational axis 46 of roller cutter 20A with leg 16 as shown at H1. At the jet or orifice exit, the drilling fluid has a maximum velocity and minimal cross sectional area. As the stream or jet travels from the exit point, the stream loses velocity and increases in cross sectional area. A reduction in velocity reduces the cleaning effectiveness of the stream of drilling fluid. A suitable height should provide an adequate flow zone from the distribution of the stream with a sufficient velocity and dispersion to effectively clean the cutting elements and the formation.

Figure 7:
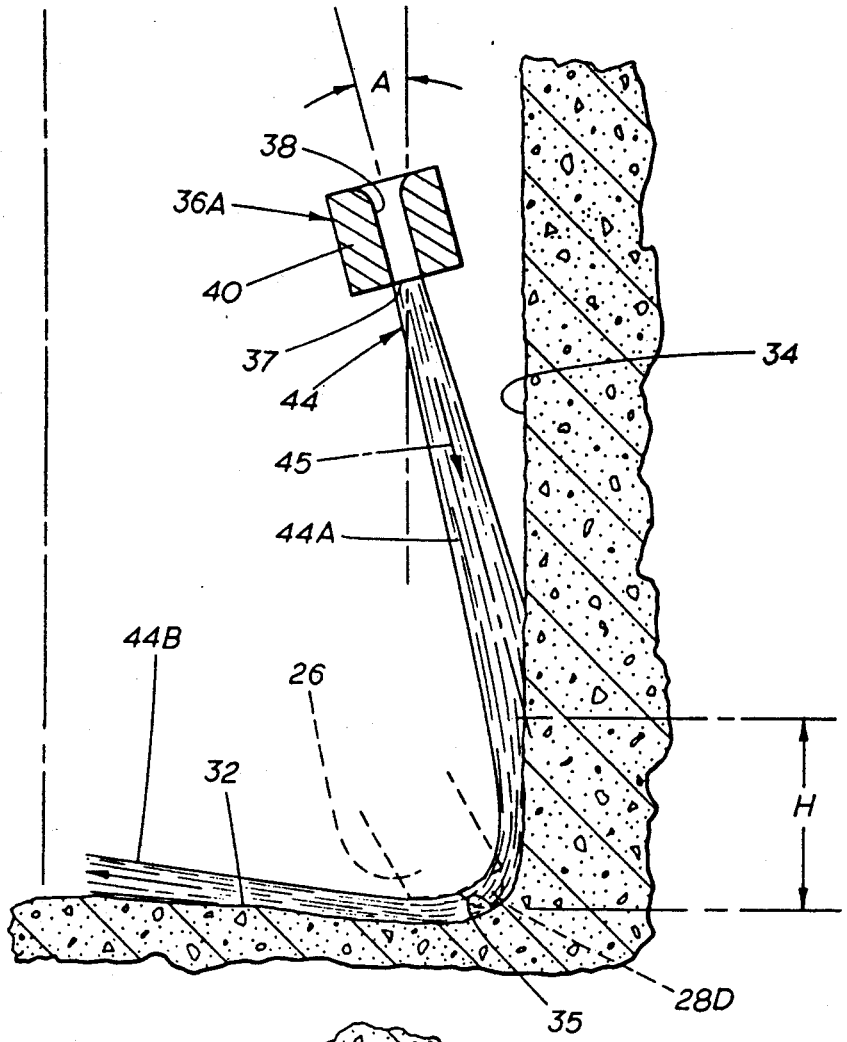
FIG. 7 is a schematic side view illustrating the stream of drilling fluid discharged from the nozzle striking the side wall and then sweeping across the hole bottom in a thin tangential stream closely adjacent the bottom surface.
Figure 8:
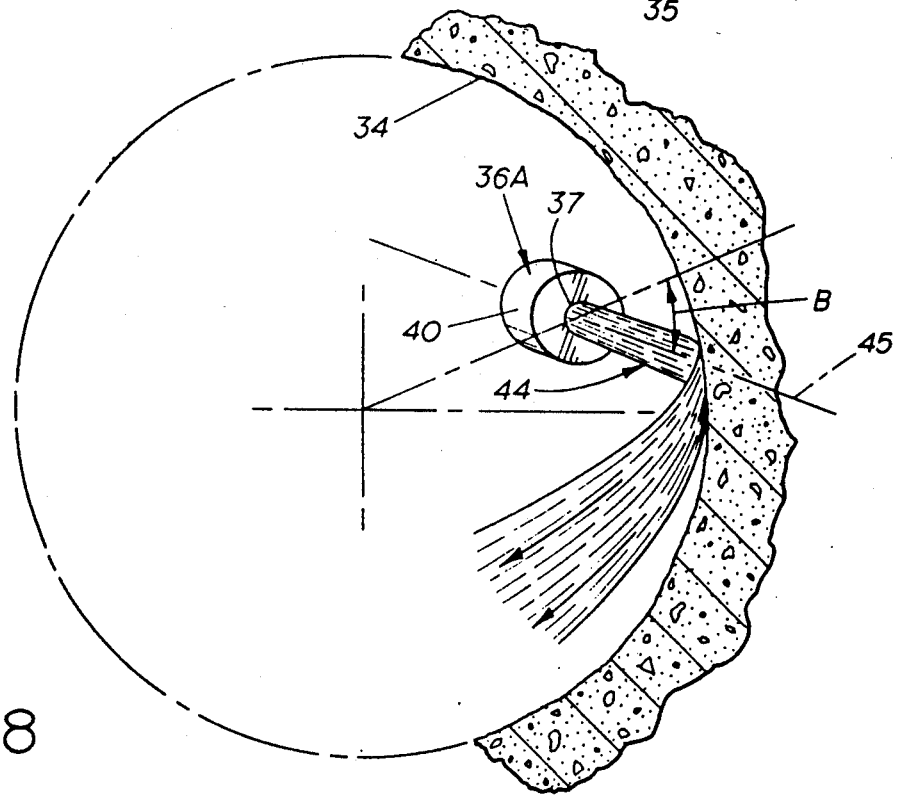
FIG. 8 is a schematic bottom plan view illustrating the flow of the high velocity stream shown in FIG. 7.

It is desirable for the sweeping of the drilling fluid stream inwardly beneath the cutting elements on the associated cutter 20A that the drilling fluid stream 44 first contact the side wall 34 of the bore hole 40. Fluid stream 44 is inclined radially outward at an angle A as shown in FIGS. 3 and 7 of an optimum of around fifteen degrees. Angle A may be between five degrees and thirty five degrees and function satisfactory. If angle A is over around thirty five degrees, the velocity of the drilling fluid stream 44 is materially reduced from the deflection of the stream after striking side wall 34 which is undesirable for the subsequent sweeping tangential action beneath the cutting elements during the cutting operation.

In addition, it is desirable for the centerline of flow stream 44 to strike the side wall at a predetermined height a the lowermost cutting elements in the gage row 28D. A height H as measured above the center of corner surface 35 as shown in FIG. 3 of around 1½ inch for a bit diameter of 8¾ inches has been found to be optimum. Height H is preferably at least around ½ inch and may be substantially higher than 1½ inches dependent somewhat on the angle A of radial inclination. With a small amount of radial inclination such as five degrees, a greater height of impact could be provided. However, in order to obtain a maximum velocity stream in a direction tangential to the formation surface with a maximum volume for sweeping across bottom surface 32 underneath cutter 20A height H should not be above around four (4) inches. It is further noted that side wall 34 tends to flatten stream 44 into a stream for sweeping across bottom surface 32. As shown particularly in FIG. 7, for example, stream 44 is of a generally frustoconical shape from port 37 to side wall 34 as shown at 44A. After striking side wall 34, stream 44 is converted into a flat generally elliptical cross section at 44B for sweeping across the curved surface of the hole corner and hole bottom at a high velocity in a direction tangential to the surface of the formation.

Figure 5:
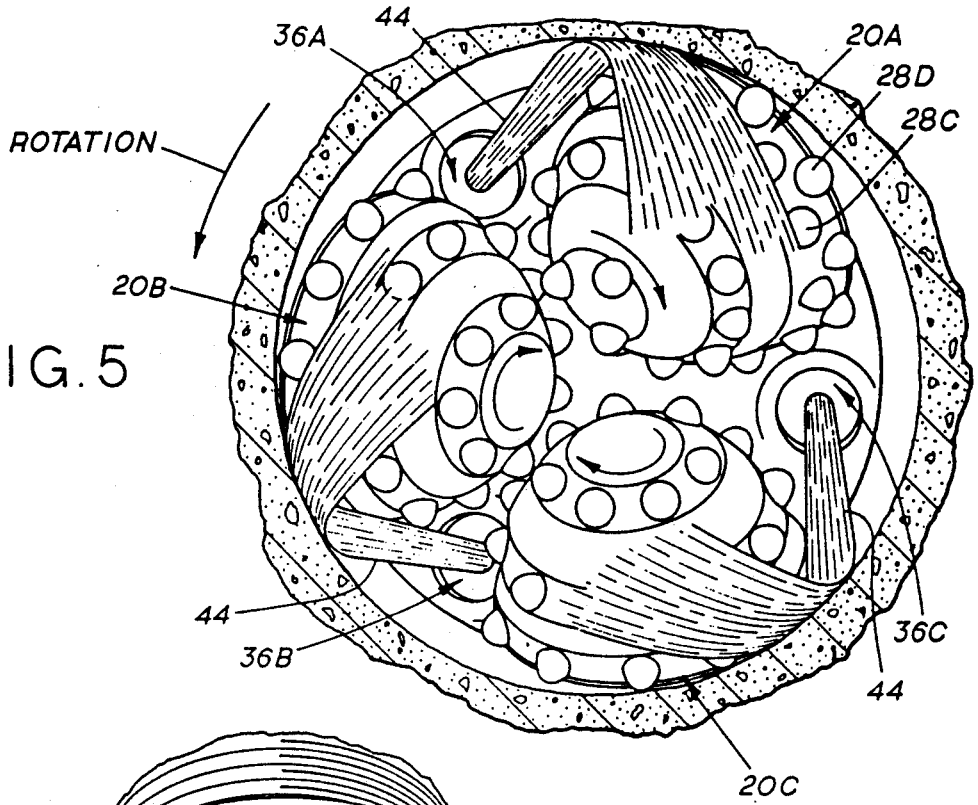
FIG. 5 is a bottom plan, partly schematic, of the streams of drilling fluid first striking the side wall of the bore hole and then sweeping inwardly across the gage corner and then the hole bottom beneath the roller cutters during cutting engagement of the cutting elements with the formation.
Figure 6:
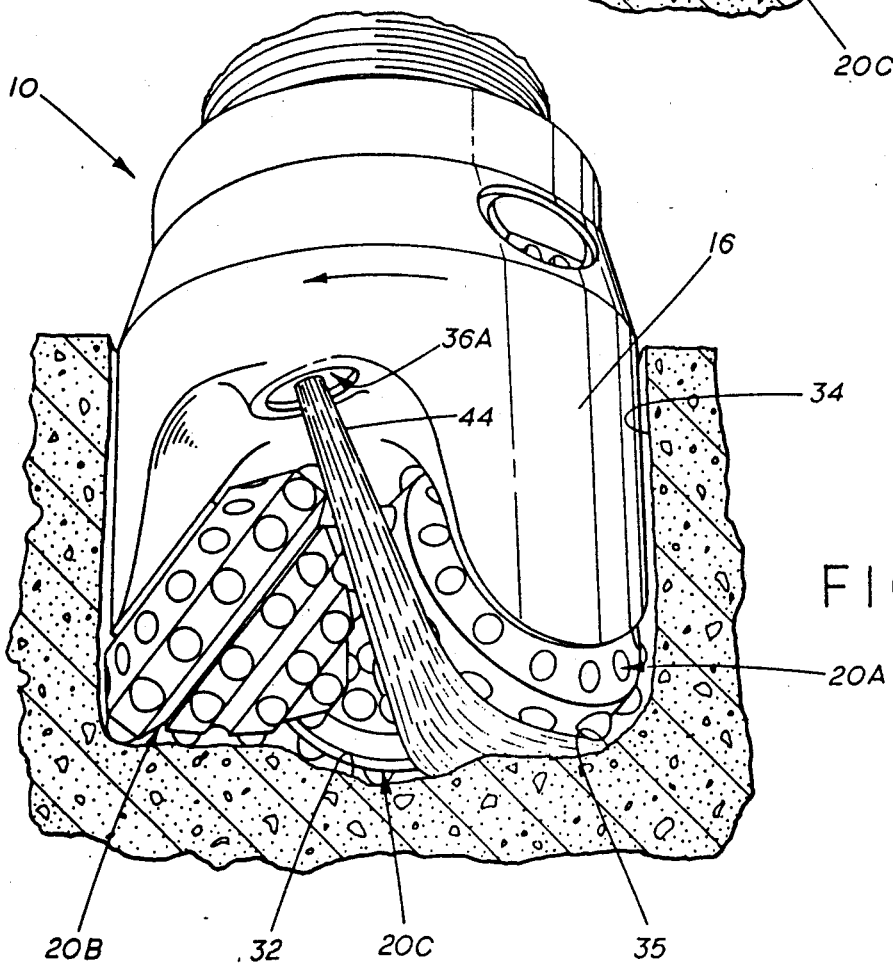
FIG. 6 is a perspective, partly schematic, showing the angled relation of the stream for minimizing reduction in velocity after striking the side wall and subsequent sweeping across the hole corner and bottom in a tangential direction beneath the adjacent cutter.

In order for the drilling fluid stream 44 to gain access to sweep under the cutting elements of roller cutter 20A and particularly gage row 28D and interlocking row 28C during cutting engagement, it is desirable to slant or s stream 44 toward the leading side of the trailing cutter 20A and to position nozzle 36A closer to side wall 34 than to the axis of bit rotation. The slant angle B as measured in a direction perpendicular to the radial plane through the axis of drill bit 10 and the nozzle exit port 37 is preferably around twenty degrees as shown particularly in FIG. 4. A side portion of stream 44 contacts the projecting ends of cutting elements 26 in gage row 28D and interlocking row 28C for cleaning the gage and interlocking rows immediately before the cutting elements 26 in rows 28C and 28D engage the formation in cutting relation and before impingement of the stream 44 against side wall 34. After striking side wall 34, stream 44 is directed by side wall 34 around the gage corner 35 with the centerline 45 of stream 44 closely adjacent cutting elements 26 in gage row 28D at the cutting engagement area of gage row 28D with the formation as shown in FIG. 5, and then inwardly across bottom surface 22 tangential to the formation surface beneath cutting elements 26 of roller cutter 20A, particularly gage row 28D and interlocking row 28C. Thus, after striking side wall 34, stream 44 closely follows the contour of corner 35 and bottom surface 32 in a thin high velocity stream thereby providing a relatively thin high velocity stream sweeping across corner 35 and bottom surface 32 for cleaning and scouring the surface immediately before and during cutting engagement of the cutting elements 26 of roller cutter 20A and particularly the interlocking and gage rows 28C and 28D.

From the foregoing, it is apparent that an improved cleaning and hydraulic action is provided by the positioning and angling of a stream of drilling fluid from a discharge nozzle positioned between a pair of adjacent roller cutters. The stream is inclined radially outwardly and slanted toward an adjacent roller cutter at precise predetermined angles in order to obtain the desired cleaning effect by the high velocity fluid first striking the side wall of the bore hole and then sweeping inwardly in a thin tangential stream closely following the contour of the formation around the gage corner and across the bottom surface of the bore hole beneath the cutting elements of the adjacent cutter while the cutting elements are in cutting engagement with the formation.

While a preferred embodiment of the present invention has been illustrated, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A rotary drill bit for drilling a bore hole comprising:

a bit body having an upper end adapted to be connected to a drill string for rotating the bit and for delivering drill fluid to the bit, and having three integrally connected legs extending from the lower end thereof, each leg including a journal on the extending end thereof having a longitudinal axis extending downwardly and generally radially inwardly of said leg;

a roller cutter mounted for rotation about the longitudinal axis of each journal and having a plurality of rows of cutting elements including an outer gage row; and a separate nozzle on said bit body positioned between each pair of adjacent roller cutters closer to the bore hole side wall than to the axis of rotation of said bit and having a discharge port for directing a stream of drilling fluid toward one of said adjacent roller cutters with the center of the volume of discharged drilling fluid first striking the side wall of the bore at a location above the lowermost cutting elements in said gage row, said stream of drilling fluid being slanted toward said one adjacent roller cutter at an angle of at least around 10 degrees as measured in a direction at right angles to the radius of said rill bit, said stream of drilling fluid being inclined radially outward from said discharge port at an angle of between around 5 degrees and 35 degrees relative to the rotational axis of the drill bit for first striking the side wall and then being directed by the side wall in a sweeping action across the bore hole corner with the center of said stream closely adjacent the cutting elements in said gage row at the cutting engagement area of said gage row with the formation, and then sweeping across the bottom in a high velocity thin stream following the contour of the bore hole underneath the cutting elements of said one of the adjacent roller cutters during cutting engagement of the cutting elements with the bore hole.

2. A rotary drill bit as set forth in claim 1 wherein at least a side portion of said stream of drilling fluid contacts the cutting elements in said gage row prior to striking said side wall.

3. A rotary drill bit as set forth in claim 2 wherein said stream of drilling fluid after contacting said gage row of cutting elements and said side wall then sweeps across the bore hole corner and bottom underneath said one adjacent roller cutter during cutting engagement of the cutting elements.

4. A rotary drill bit as set forth in claim 1 wherein said discharge port for said nozzle is positioned to direct drilling fluid in a stream against the side wall at a location with the center of the volume of discharged drilling fluid being at least one half inch above the lowermost cutting elements in said gage row.

5. A rotary drill bit as set forth in claim 1 wherein said discharge port for said nozzle is positioned to direct drilling fluid in a stream against the side wall for striking the side wall between around ½ inch and 4 inches above the lowermost cutting elements in said gage row thereby to flatten said stream for sweeping across the bore hole bottom.

6. A rotary drill bit for drilling a bore hole comprising:

a bit body having an upper end adapted to be connected to a drill string for rotating the bit and for delivering drilling fluid to the bit, and having legs extending from the lower end thereof, each leg including a generally cylindrical journal on the extending end thereof having a longitudinal axis extending downwardly and generally radially inwardly of said leg;

a roller cutter mounted for rotation about the longitudinal axis of each journal and having a plurality of cutting elements including an outer gage row; and a separate nozzle on said bit body positioned between each pair of adjacent roller cutters closer to the bore hole wall than to the axis of rotation of said bit and having a discharge port for drilling fluid positioned at a height at least above the intersection of the longitudinal axes of said journals with said legs, said discharge port directing a stream of drilling fluid toward the leading side of the trailing adjacent roller cutter with the center of the volume of discharged drilling fluid first striking the side wall of the bore hole at a location above the lowermost cutting elements in said gage row, said stream of drilling fluid being inclined radially outward from said discharge port an angle of between around five degrees and thirty five degrees relative to the rotational axis of the drill bit;

said stream of drilling fluid being slanted against the direction of rotation of said drill bit and toward the leading side of said trailing adjacent roller cutter at an angle of at least around ten degrees as measured in a direction at right angles to the radius of said drill bit for sweeping after first striking said side wall across the bore hole corner with the center of said stream closely adjacent the cutting elements in said gage row at the cutting engagement area of said gage row with the formation, and then sweeping across the bottom in a high velocity thin stream following the contour of the bore hole underneath the cutting elements in said adjacent roller cutter during cutting engagement of said cutting elements.

7. A rotary drill bit as set forth in claim 6 wherein said stream of drilling fluid is angled from said discharge port so that at least a side portion of said stream of drilling fluid contacts the cutting elements in said gage row prior to striking said side wall.

8. A rotary drill bit as set forth in claim 6 wherein said stream of drilling fluid strikes said side wall at a height between around ½ inch and 4 inches above the lowermost cutting elements in said gage row thereby to flatten said stream for sweeping across the bore hole bottom thereafter.

9. A rotary drill bit for drilling a bore hole comprising:

a bit body having an upper end adapted to be connected to a drill string for rotating the bit and for delivering drill fluid to the bit, and having three integrally connected legs extending from the lower end thereof, each leg including a generally cylindrical journal on the extending end thereof having a longitudinal axis extending downwardly and generally radially inwardly of said leg;

a roller cutter mounted for rotation about the longitudinal axis of each journal and having a plurality of rows of cutting elements including an outer gage row; and a separate nozzle on said bit body positioned between each pair of adjacent roller cutters closer to the bore hole side wall than to the axis of rotation of said bit and having a discharge port for drilling fluid positioned at a height at least above the intersection of the longitudinal axes of said journals with said legs, said discharge port of each nozzle directing a stream of drilling fluid toward an adjacent roller cutter with the center of the volume of discharged drilling fluid first striking the side wall of the bore hole at a location above the lowermost cutting elements in said gage row, said stream of drilling fluid discharged from each nozzle being slanted toward said adjacent roller cutter at an angle of at least around 10 degrees as measured in a direction at right angles to the radius of said drill bit for sweeping across the bore hole bottom inwardly of said side wall in a high velocity thin stream in a direction following generally the contour of the bore hole surface, said stream of drilling fluid being inclined radially outward from said discharge port at an angle of between around 5 degrees and 35 degrees relative to the rotational axis of the drill bit for first striking the side wall, each nozzle being positioned to direct drilling fluid against the side wall for striking the side wall at a height between around ½ inch and 4 inches above the center of the bore hole corner surface with said side wall flattening and directing said stream in a sweeping action with the center of said stream closely adjacent the cutting elements in said gage row at the cutting engagement area of said gage row with the formation, then across the bore hole bottom in a direction following the contour of the formation surface underneath the adjacent cutter during cutting engagement of the cutting elements.

10. A rotary drill bit as set forth in claim 9 wherein each nozzle is angled toward an adjacent roller cutter so that at least a side portion of the discharged stream contacts the cutting elements in said gage row prior to striking said side wall.

* * * * *